US007771509B1

(12) United States Patent
Brown

(10) Patent No.: US 7,771,509 B1
(45) Date of Patent: Aug. 10, 2010

(54) MAGNETIC OXYGEN CONCENTRATOR FOR AIR STREAMS

(75) Inventor: Ross M. Brown, Escondido, CA (US)

(73) Assignee: Cryogenic Group, Inc., Murrieta, CA (US)

( * ) Notice: Subject to any disclaimer, the term of this patent is extended or adjusted under 35 U.S.C. 154(b) by 375 days.

(21) Appl. No.: 11/899,532

(22) Filed: Sep. 7, 2007

(51) Int. Cl.
*B03C 1/02* (2006.01)
*B03C 1/30* (2006.01)

(52) U.S. Cl. ..... 95/28; 62/322; 62/617; 62/914; 95/39; 96/1

(58) Field of Classification Search ..... 95/28, 95/39; 96/1; 62/322, 617, 640, 914
See application file for complete search history.

(56) References Cited

U.S. PATENT DOCUMENTS 4,704,139 A * 11/1987 Yamamoto et al. ..... 95/28
5,779,770 A * 7/1998 Nitta et al. ..... 96/2
5,820,654 A * 10/1998 Gottzman et al. ..... 95/54
6,562,105 B2 * 5/2003 Gottzmann ..... 95/54
6,787,044 B1 * 9/2004 Freeman et al. ..... 210/695
7,288,138 B2 * 10/2007 Showalter et al. ..... 96/1
2004/0159232 A1 * 8/2004 Mohamed ..... 95/28
2009/0178556 A1 * 7/2009 Hoshi et al. ..... 95/28

FOREIGN PATENT DOCUMENTS

JP 55-137024 A * 10/1980 ..... 96/1
JP 60-46903 A * 3/1985 ..... 96/1

* cited by examiner

*Primary Examiner*—Richard L Chiesa
(74) *Attorney, Agent, or Firm*—William W. Haefliger

(57) ABSTRACT

A process for separating $O_2$ from air, that includes the steps effecting an increase in pressure of an air stream, magnetically concentrating $O_2$ in one portion of the pressurized air stream, the one portion then being an oxygen rich stream, and there being another portion of the air stream being an oxygen lean stream, compressing the oxygen rich stream and removing water and carbon dioxide therefrom, to provide a resultant stream, and cryogenically separating said resultant stream into a concentrated oxygen stream and a waste stream.

17 Claims, 4 Drawing Sheets

MAGNETIC OXYGEN CONCENTRATOR FOR AIR STREAMS

BACKGROUND OF THE INVENTION

This invention relates generally to oxygen concentration, and more particularly to apparatus and methods for employing magnetism for air stream oxygen concentration.

Air is commonly used as a source of oxygen (21% mol percent of dry air). Many uses of oxygen can benefit from an enriched composition. In combustion processes, the 79% non-oxygen content can represent either a contaminant, or a carrier of a contaminant, in the exhaust products. When it is to be used in its near pure state, oxygen must be separated from air, which conventionally requires a considerable expenditure of power. The enhancement of the oxygen content in air by only modest amounts can result in benefits to many oxygen-using processes, either in power reduction and/or air pollution reductions.

Most gases are diamagnetic; that is, they tend to be repelled from a magnetic field. Only a very few gases are paramagnetic and tend to be attracted into or toward a magnetic field, and of these, oxygen is the only common gas. It is a very important circumstance that the magnitude of the magnetic susceptibility of oxygen is many times greater than that of any other common gas. As an example, the volume magnetic susceptibility of oxygen at standard conditions, $142\times10^{-9}$ cgs, may be compared with that of nitrogen, $-0.40\times10^{-9}$ cgs.

Recent developments in large high field magnets (particularly of the superconducting type) have made it feasible to create a very intense magnetic field at a modest cost and very low operating costs. There is need to adapt such magnets to oxygen separation.

SUMMARY OF THE INVENTION

It is a major object of the present invention to provide apparatus and methods to meet the above needs. Further, the invention combines very powerful magnetic field capability with the paramagnetic characteristics of oxygen to perform a separation in air streams, generating an enhanced oxygen stream.

Accordingly, the invention is basically embodied in a method which includes:

a) effecting an increase in pressure of an air stream, b) magnetically concentrating $O_2$ in one portion of the pressurized air stream, said one portion then being an oxygen rich stream, and there being another portion of the air stream which is an oxygen lean stream, c) compressing the oxygen rich stream and removing water and carbon dioxide therefrom to provide a resultant stream, d) and cryogenically separating that resultant stream into a concentrated oxygen stream and a waste stream.

Additional objects include:

i) provision of a process or method as referred to wherein the concentrated oxygen stream contains at least about 99% oxygen, and the waste stream contains less than about 5% oxygen, ii) provision of a process, as described wherein the oxygen rich air stream has an oxygen content of about 30%, and the oxygen lean air stream has an oxygen content of about 20%, iii) provision of such a process wherein an air compressor is employed in step a), operating at a reduced work output compensated for by operation of said magnetic concentrating of $O_2$, iv) employing a super conducting magnetic separator to effect the step b), concentration of $O_2$ in the referenced one portion of the pressurized air stream, v) employing an air scoop or scoops to separate the magnetically concentrated oxygen in said one portion of the pressurized air stream, and to separate the oxygen lean stream, vi) recycling the oxygen rich product stream to enhance oxygen enrichment, vii) employing the oxygen rich product air stream in auxiliary processes such as pressure swing absorption, power plants, sewage treatment plants, chemical process plants, bleaching in paper manufacture, and in metallurgical processes.

These and other objects and advantages of the invention, as well as the details of an illustrative embodiment, will be more fully understood from the following specification and drawings, in which:

DRAWING DESCRIPTION

DETAILED DESCRIPTION

Figure 1:
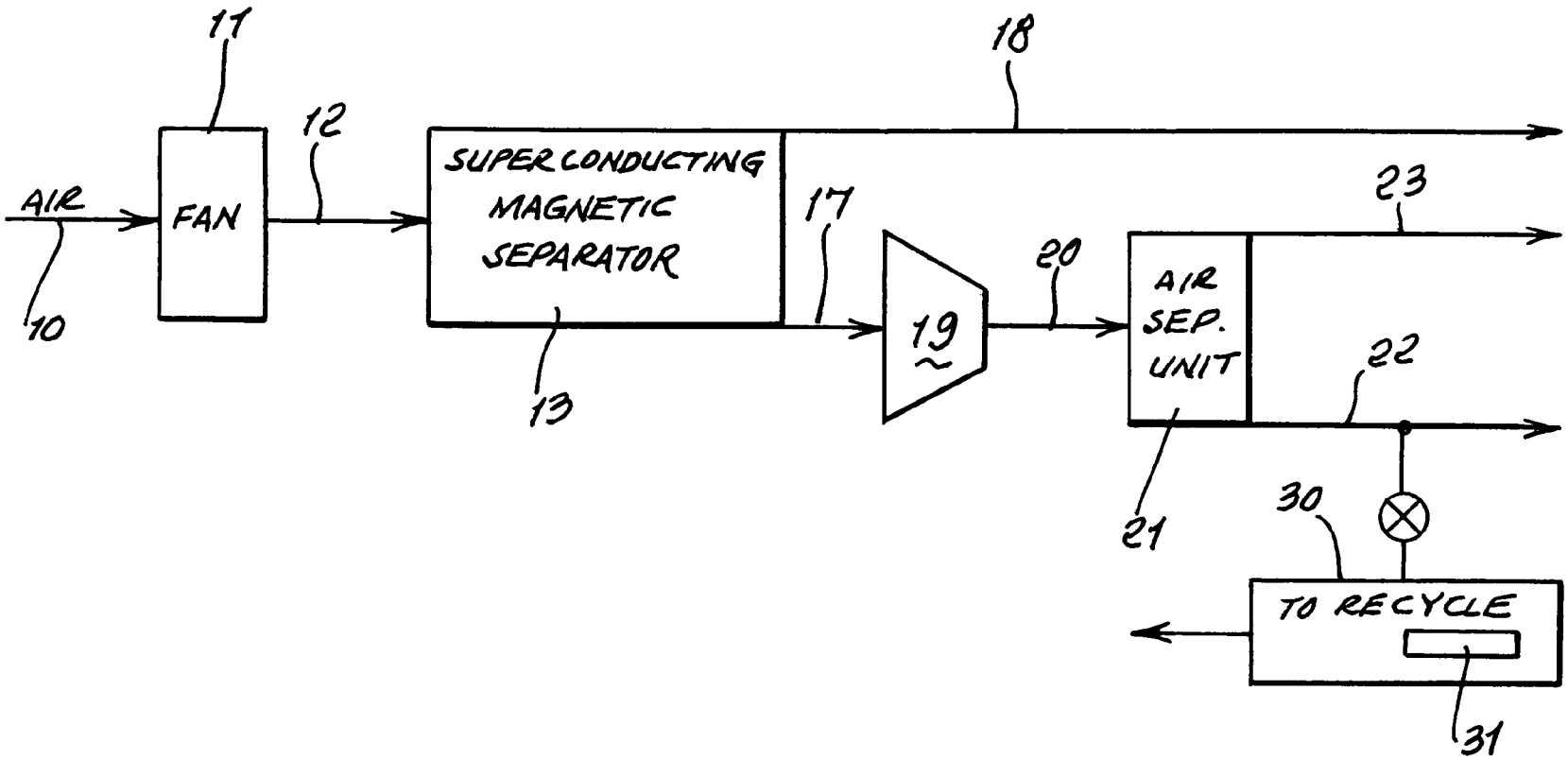
FIG. 1 is a process flow diagram.

FIG. 1 illustrates an example of the process. In this example 1000 kgmol/hr of air at 10 enters a fan 11 where pressure is boosted to about 0.01 bar. The boosted air at 12, after passage through a flow straightener 45 (see FIG. 2), enters a superconducting magnetic separator 13 wherein the magnetic fields 46 are configured to concentrate the oxygen molecules in one portion of the air stream. A scoop separates a rich air stream of 100 kgmol/hr with an oxygen content of 30% from a lean stream of 900 kgmol/hr and an oxygen content of 20%.

Figure 2:
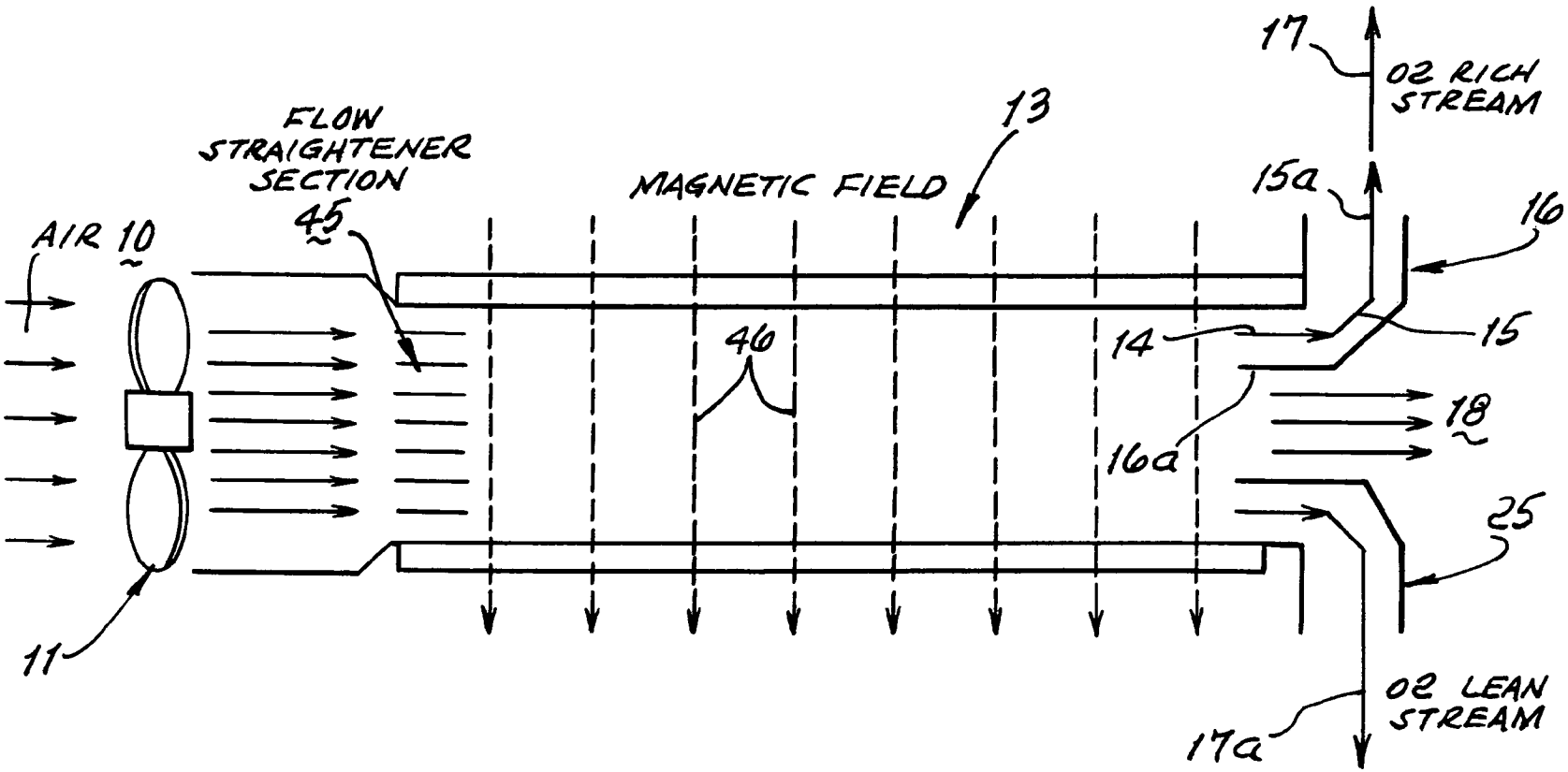
FIGS. 2 and 3 show uses of scoops.

This is shown schematically in FIG. 2, in which air stream 14 exiting the magnetic separator, and containing a magnetically concentrated oxygen layer 15 impinges an edge 16*a* of a scoop 16. The scooped layer is separated at 15*a* and flows as rich stream 17, the unscooped lean product stream flowing at 18 as a waste stream. A second scoop 25 may be employed to remove an oxygen lean stream 17*b*. It will be noted that the scoops are configured for by-passing flow of a portion of the air stream as a waste stream. Also the scoops are spaced apart in the direction of a magnetic field produced for said magnetic concentrating, and including allowing passage of said third stream between said scoops.

The rich stream 17 enters a main compressor 19 (see FIG. 1) where it is compressed to about 6 barg, and after removing water and carbon dioxide at 20 is cryogenically separated at 21 into a "pure" oxygen stream 22 (99+%) and a waste stream 23 of less than about 5% oxygen.

In this example (given parameters are illustrative, and may vary in each specific application) the efficiency value of the magnetic pre-processor is important. Thus, compressor 19 only has to compress about ⅔ of the number of molecules (as compared with a process omitting the magnetic separator) to get the same number of oxygen molecules in the rich product stream 22. The power savings (about ⅓) is slightly offset by the power consumed in the fan and the power consumed in keeping the magnet super cool, but these power loads are only a small fraction of the saved power.

Figure 4:
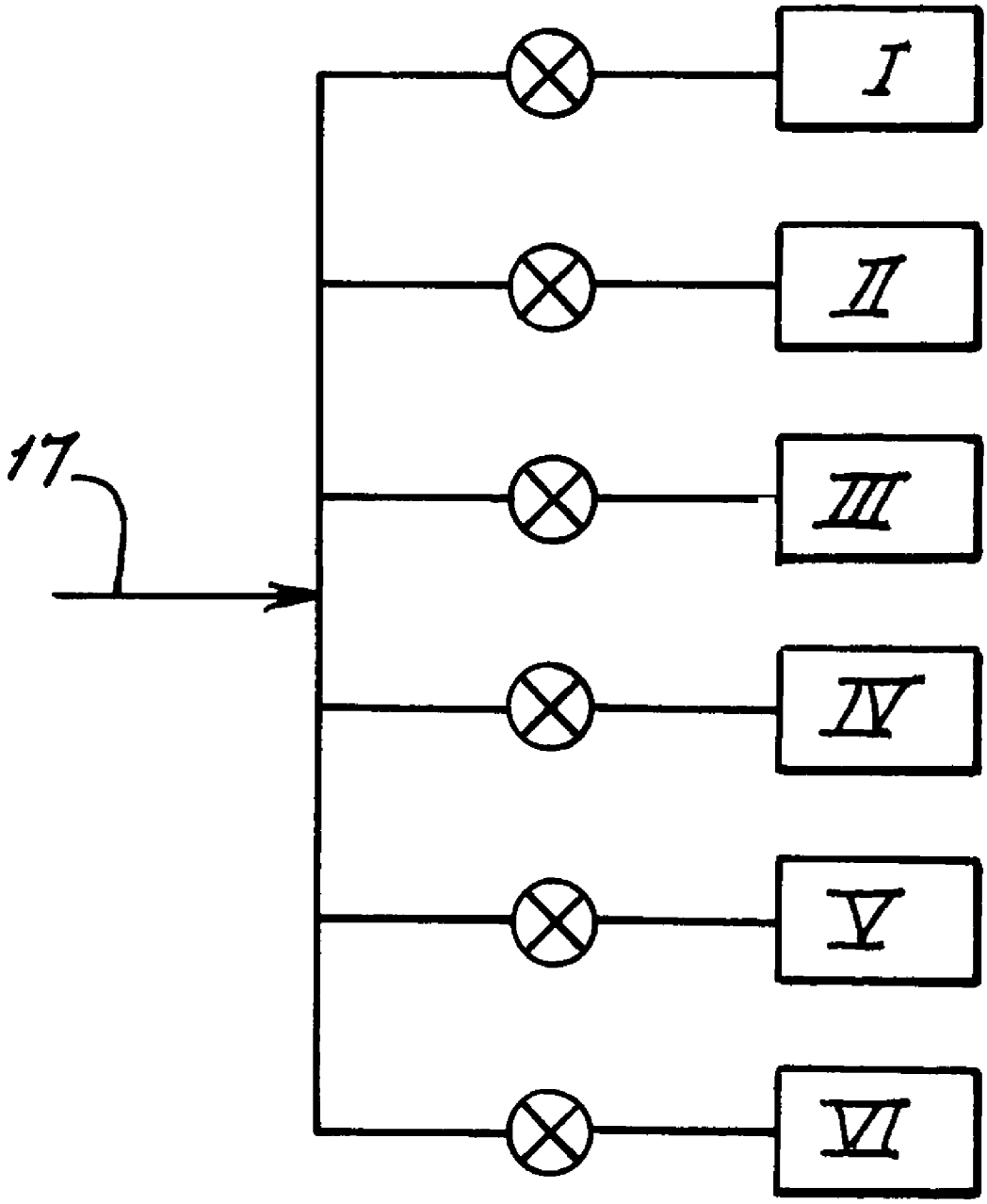
FIG. 4 is a diagram showing use of magnetically separated pure oxygen in auxiliary processes.

In the above example, a conventional cryogenic air separation step at 21 may be employed. It is a good example because the power saving per ton of oxygen is high. There are, however, many other applications where enhanced oxygen concentration in air is beneficial. In these cases there may not be a requirement for the equipment down stream of the magnetic separator. A partial list of applications would include, the following, with reference to FIG. 4.

I Oxygen by pressure swing absorption
II Combustion air for large power plants
III Sewage treatment
IV Oxygen in chemical process plants
V Bleaching operations in paper making
VI Metallurgical processes There is another important aspect to the magnetic oxygen concentration, as in an application where the lean waste stream is desired instead of the "rich" one. In this case, it is possible to reposition the scoop or scoops to produce a highly oxygen deleted or lean stream. Thus, two scoops, properly arranged, can produce two product streams 17 and 17*a* one rich and one lean and a waste stream 18 for the remainder. This is shown in FIG. 3.

While the examples show a single stage of separation, multiple stages can be employed for greater concentration. The multiple stages may be equipped with recycle fans to improve overall recovery and performance. See FIG. 1, with recycle step 30, and a recycle fan 31.

Figure 3:
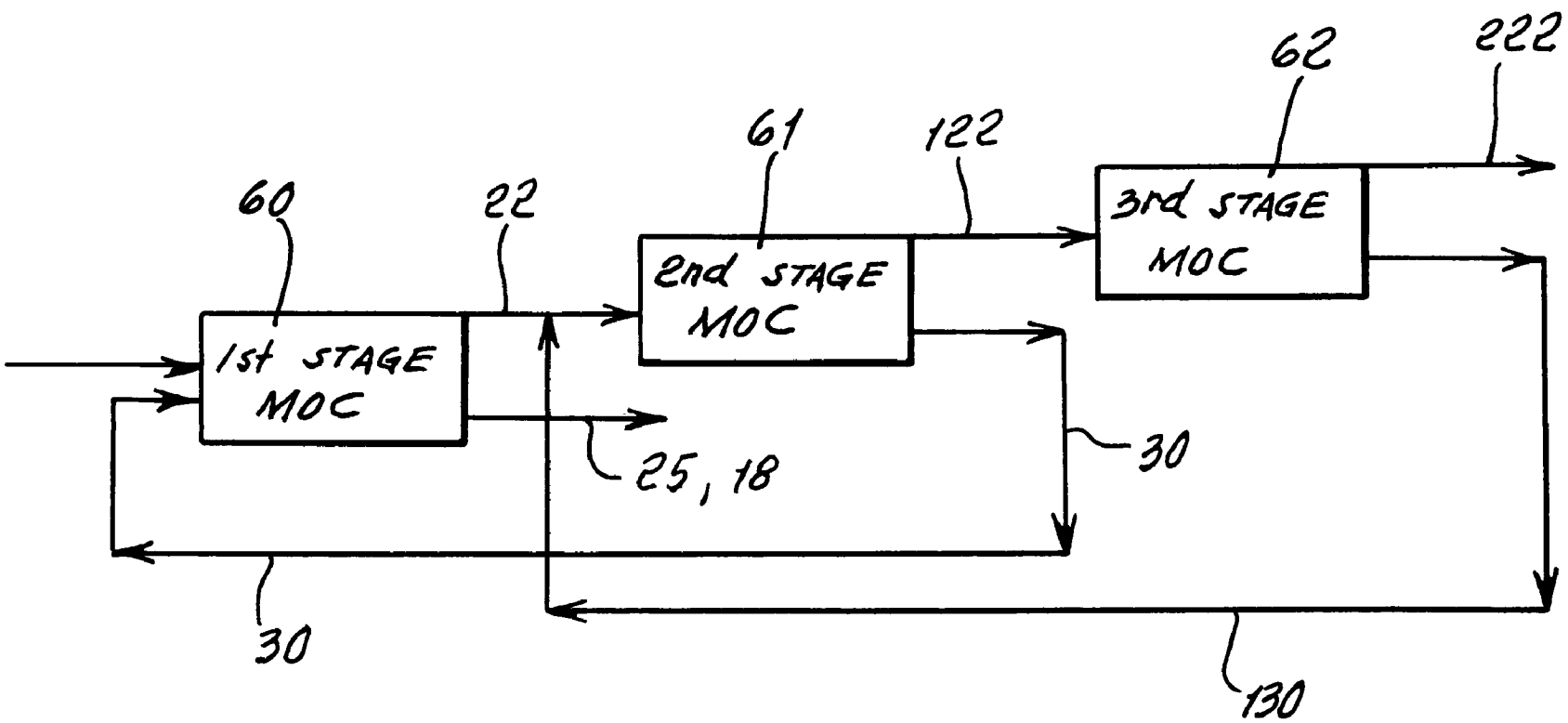

FIG. 3 schematically shows re-cycling steps in a three stage magnetically oxygen concentrating system, the stages indicated at 60, 61 and 62. Stage 60 produces $O_2$ rich stream 22 fed to stage 61, which produces richer $O_2$ air stream 122. The latter is fed to stage 62, which produces richest $O_2$ air stream 222.

Stage 60 also produces $O_2$ lean, and waste streams as per FIG. 2, and indicated at 25 and 18. Stage 61 also produces waste stream recycled at 30 to the inlet of stage 60. Stage 62 produces waste stream 130, recycled to the inlet of stage 61.

The multiple stages may be equipped with recycle fans to improve overall recovery and performance.

Another variant recognizes that the fan, while overcoming the inherent pressure drops, is not the only way to provide circulation. Alternate methods can be used, such as, thermal (as in a chimney), injector-powered devices or moving the magnetic separator through a still air source.

I claim:

1. A process for separating $O_2$ from air, that includes the steps a) effecting an increase in pressure of an air stream, b) magnetically concentrating $O_2$ in one portion of the pressurized air stream, said one portion then being an oxygen rich stream, and there being another portion of the air stream being an oxygen lean stream, c) compressing the oxygen rich stream and removing water and carbon dioxide therefrom, to provide a resultant stream, d) and cryogenically separating said resultant stream into a concentrated oxygen stream and a waste stream.

2. The process of claim 1 wherein said step d) concentrated oxygen stream contains at least about 99% oxygen, and said waste stream contains less than about 5% oxygen.

3. The process of claim 1 wherein said step b) oxygen rich air stream has an oxygen content of about 30% and said oxygen lean air stream has an oxygen content of about 20%.

4. The process of claim 1 wherein said step a) employs a compressor operating at reduced work output as compensated for by operation of said magnetic concentrating of $O_2$.

5. The process of claim 1 wherein said step a) increases the pressure of said air stream to about 0.01 bar.

6. The process of claim 1 including providing an and operating a superconducting magnetic separator to effect said step b) concentrating of $O_2$ in said one portion of the pressurized air stream.

7. The process of claim 1 including providing and operating a first scoop to separate the magnetically concentrated $O_2$ in said portion of the pressurized air stream.

8. The process of claim 7 including providing and operating a second scoop to separate and remove an oxygen lean stream.

9. The process of claim 8 including removing a waste stream from the streams separated by said scoops.

10. The method of claim 1 wherein said a) step includes operating a fan to increase said air stream pressure for magnetic concentration of $O_2$.

11. The process of claim 1 wherein said step a) increases the pressure of said air stream to about 0.01 bar.

12. The process of claim 1 including one or more of the following processes receiving said oxygen rich air stream, i) oxygen input for process swing absorption
ii) combustion air input for large power plants
iii) oxygen input to a sewage treatment facility
iv) oxygen input to a chemical process plant
v) oxygen input to a bleaching operation in paper making
vi) oxygen input to a metallurgical process.

13. The claim 1 process for separating $O_2$ from air, that includes the steps:

a) providing three stages of magnetic concentration and separation of $O_2$ from air, and respectively producing rich, richer and richest $O_2$ product streams, each stage also producing a waste stream containing air and $O_2$, b) and recycling at least one of said waste streams produced by one or more of said stages back to the input side of a preceding stage.

14. A process for separating $O_2$ from air, that includes the steps a) effecting an increase in pressure of an air stream, b) magnetically concentrating $O_2$ in one portion of the pressurized air stream, said one portion then being an oxygen rich stream, and there being a second portion of the air stream being an oxygen lean stream, c) including employing a compressor operating at reduced work output as compensated for by operation of said magnetic concentrating of $O_2$.

15. The process of claim 14 including providing and operating a first scoop for removing said oxygen rich stream, and providing and operating a second scoop for removing said oxygen lean stream.

16. The process of claim 15 wherein said scoops are configured for by-passing flow of a portion of the air stream as a waste stream.

17. The process of claim 16 wherein said scoops are spaced apart in the direction of a magnetic field produced for said magnetic concentrating, and including allowing passage of said third stream between said scoops.

* * * * *